US010597185B2

(12) United States Patent
Lawrie

(10) Patent No.: US 10,597,185 B2
(45) Date of Patent: Mar. 24, 2020

(54) PACKAGING MATTRESSES AS A DOUBLE SPIRAL ROLL

(71) Applicant: Zinus Inc., San Leandro, CA (US)

(72) Inventor: Colin Lawrie, Aurora (CA)

(73) Assignee: Zinus Inc., Tracy, CA (US)

( * ) Notice: Subject to any disclaimer, the term of this patent is extended or adjusted under 35 U.S.C. 154(b) by 197 days.

(21) Appl. No.: 15/687,472

(22) Filed: Aug. 26, 2017

(65) Prior Publication Data

US 2018/0057200 A1 Mar. 1, 2018

Related U.S. Application Data

(60) Provisional application No. 62/380,374, filed on Aug. 27, 2016.

(51) Int. Cl.

| | |
|---|---|
| ***B65B 63/04*** | (2006.01) |
| ***A47C 23/00*** | (2006.01) |
| ***A47C 27/00*** | (2006.01) |
| ***B65B 11/04*** | (2006.01) |
| ***B65B 5/04*** | (2006.01) |

(Continued)

(52) U.S. Cl.

CPC ..... *B65B 63/04* (2013.01); *A47C 23/00* (2013.01); *A47C 27/00* (2013.01); *B65B 5/045* (2013.01); *B65B 11/04* (2013.01); *B65B 11/56* (2013.01); *B65B 31/00* (2013.01); *B65B 51/06* (2013.01); *B65B 63/02* (2013.01); *B65B 63/024* (2013.01); *B65B 2220/18* (2013.01)

(58) Field of Classification Search

CPC ..... B65B 11/04; B65B 11/56; B65B 2220/18; B65B 63/02; B65B 63/024; B65B 63/04; B65B 63/028; B65B 31/00; B65B 51/06; B65B 5/045; A47C 23/00; A47C 27/00; B31B 70/96; B31B 70/946; B31B 70/942

See application file for complete search history.

(56) References Cited

U.S. PATENT DOCUMENTS

| | | | | |
|---|---|---|---|---|
| 6,739,107 | B1 * | 5/2004 | Lewis | B65B 63/024 242/541.5 |
| 8,365,911 | B2 * | 2/2013 | Oh | A47C 31/00 206/389 |

(Continued)

FOREIGN PATENT DOCUMENTS

| | | | | |
|---|---|---|---|---|
| CN | 2748387 | Y * | 12/2005 | |
| EP | 1741630 | A1 * | 1/2007 | B65B 11/04 |

*Primary Examiner* — Andrew M Tecco
*Assistant Examiner* — Nicholas E Igbokwe
(74) *Attorney, Agent, or Firm* — Imperium Patent Works; Darien K. Wallace

(57) ABSTRACT

Mattresses are packaged by successively rolling two compressed mattresses into a roll in which a rolling wrapper forms a spiral when viewed from an end of the roll. The bottom surface of a first mattress is placed on the wrapper such that the wrapper wraps around a first end of the mattress. The first end is then inserted between the bars of a mechanical roller. The first end is bent over onto the top surface of the mattress, and the mattress is rolled. The bottom surface of a second mattress is placed on the wrapper, and the first mattress is further rolled until successive portions of the bottom surface of the first mattress become adjacent to successive portions of the top surface of the second mattress. The wrapper is cut, and a first location near the cut edge is taped to a second location one revolution earlier on the wrapper.

20 Claims, 11 Drawing Sheets

(51) Int. Cl.

| | |
|---|---|
| ***B65B 51/06*** | (2006.01) |
| ***B65B 63/02*** | (2006.01) |
| ***B65B 11/56*** | (2006.01) |
| ***B65B 31/00*** | (2006.01) |

(56) References Cited

U.S. PATENT DOCUMENTS

| | | | | |
|---|---|---|---|---|
| 9,796,522 | B2 * | 10/2017 | Pearce | B65D 33/02 |
| 2005/0040278 | A1 * | 2/2005 | Allgood | B65D 33/002<br>242/521 |
| 2005/0066624 | A1 * | 3/2005 | Dextraze | B65B 31/06<br>53/399 |
| 2007/0245490 | A1 * | 10/2007 | Oh | A47F 5/0018<br>5/413 R |
| 2008/0086984 | A1 * | 4/2008 | Andria | B65B 13/20<br>53/434 |
| 2016/0052702 | A1 * | 2/2016 | Lawrie | B65B 67/02<br>211/85.24 |

* cited by examiner

PACKAGING MATTRESSES AS A DOUBLE SPIRAL ROLL

CROSS REFERENCE TO RELATED APPLICATIONS

This application claims priority under 35 U.S.C. § 119 from U.S. Provisional Application No. 62/380,374, entitled "Packaging Mattresses as a Double Spiral Roll," filed on Aug. 27, 2016, the subject matter of which is incorporated herein by reference.

TECHNICAL FIELD

The described embodiments relate to packaging for mattresses, and more particularly to packaging two mattresses together as a roll in a shipping box.

BACKGROUND INFORMATION

Due to the bulkiness of mattresses, the cost of transportation and storage in the supply chain from the factory to the retail store is a significant component in the overall price of each mattress. To facilitate transportation, storage and display of mattresses, mattresses are sometimes rolled and compressed into cylindrical rolls. Each roll is then packed into a container such as a cardboard box. The container is transported to the retail store and is placed on a retail-store merchandise shelf to be purchased by a retail consumer. Compressing and rolling each mattress reduces both the shipping and warehousing costs and allows mattresses to be sold at a lower price. A method is sought for saving even more space in the transportation and storage of mattresses that can even further lower the cost of delivering mattresses to the retail consumer.

SUMMARY

Mattresses are packaged by successively rolling two compressed mattresses into a roll in which a rolling wrapper makes a spiral when viewed from an end of the roll. The bottom surface of the first mattress is placed on the wrapper such that the wrapper wraps around a first end and onto a top surface of the mattress. The first end is then inserted between the bars of a mechanical roller. The first end is bent over onto the top surface of the mattress. The mattress is further rolled until successive portions of the bottom surface of the mattress become adjacent to successive portions of the top surface of the mattress. The bottom surface of a second mattress is placed on the wrapper, and the first mattress is further rolled until successive portions of the bottom surface of the first mattress become adjacent to successive portions of the top surface of the second mattress. The wrapper is cut, and a first location near the cut edge is taped to a second location one revolution earlier on the wrapper.

A method of packaging mattresses involves rolling two compressed mattresses one after the other into a cylindrical roll in which a rolling wrapper forms a spiral when viewed from an end of the roll. A first compressed mattress is inserted into a sheath made of an airtight material. The first mattress is compressed such that air exits the sheath. The sheath is sealed such that air is prevented from re-entering the sheath, which would allow the compressed mattress to expand.

The bottom surface of the first mattress is placed on a rolling wrapper such that the rolling wrapper wraps around a first end of the first mattress and onto a top surface of the first mattress. The first end of the first mattress is then inserted into a mechanical roller. For example, the end of the first mattress is inserted between two bars of the mechanical roller. The first mattress is rolled by bending the first end of the first mattress over onto the top surface of the first mattress. Both the top surface and the bottom surface of the first mattress are covered by the rolling wrapper where the first end of the first mattress is rolled over onto the top surface of the first mattress.

The mechanical roller continues to roll the first mattress such that successive portions of the bottom surface of the first mattress become adjacent to successive portions of the top surface of the first mattress. The bottom surface of a second mattress is placed on the rolling wrapper such that a first end of the second mattress is adjacent to a second end of the first mattress. The first mattress is continued to be rolled until successive portions of the bottom surface of the first mattress become adjacent to successive portions of a top surface of the second mattress. The first mattress is further rolled until successive portions of the bottom surface of the second mattress become adjacent to successive portions of the top surface of the second mattress. After the rolling wrapper is cut, a first location on the wrapper near the cut edge that has completed an additional wrap around the second mattress is taped to a second location on the rolling wrapper.

Further details and embodiments are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Figure 1:
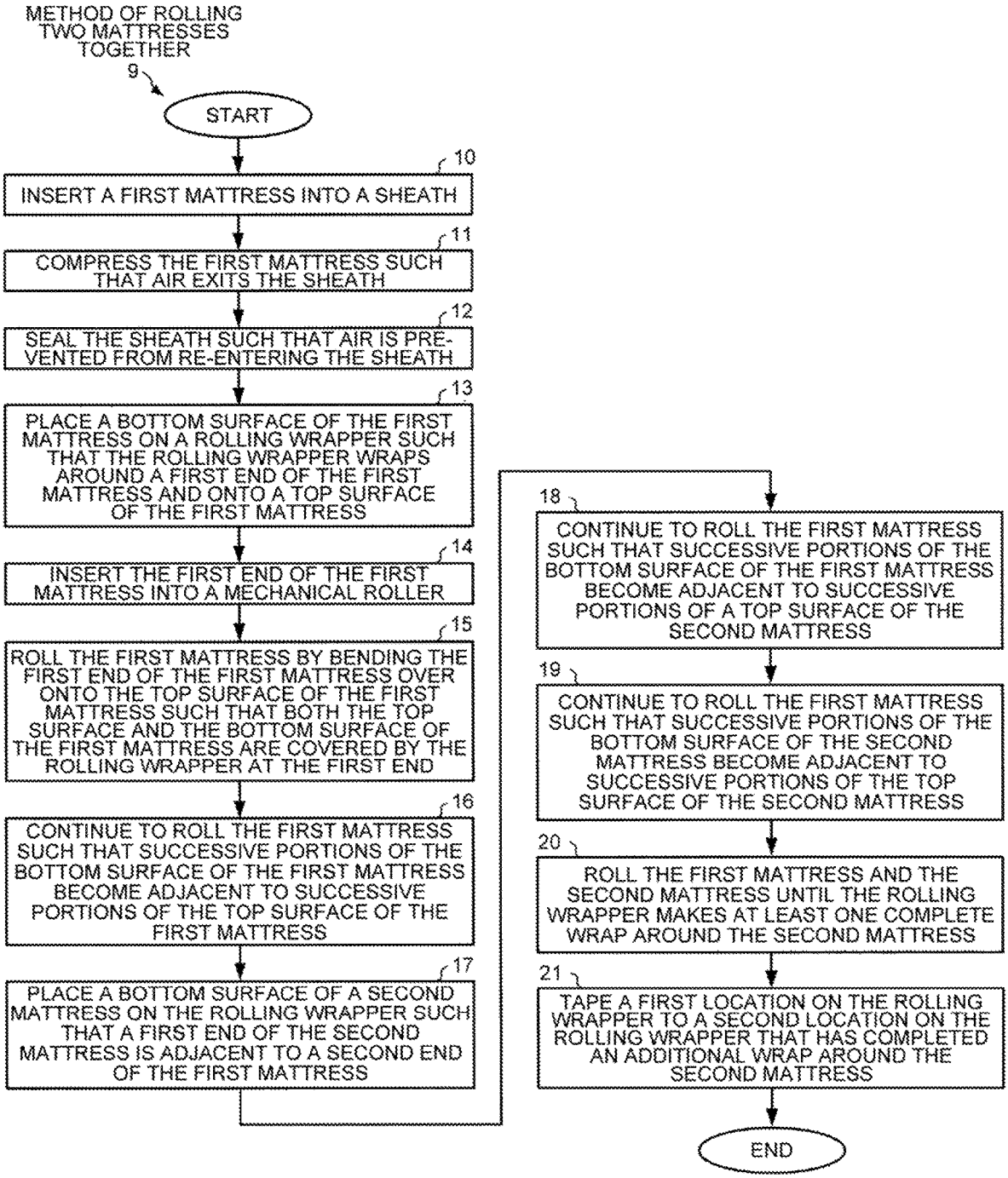
FIG. 1 is a flowchart of steps of a method of rolling two mattresses into a single roll and packaging the mattresses together.

FIG. 1 is a flowchart of steps 10-20 of a method 9 of rolling two mattresses into a single roll and packaging the mattresses together. The steps of method 9 will now be described in relation to the mattresses shown in FIGS. 2-20.

In a first step 10, a first mattress 22 is inserted into a sheath 23. The sheath 23 is made of a material that is not permeable to air, such as a film of polypropylene. In this embodiment, the first mattress 22 has been inserted into a tube of polypropylene film in which a first end has been closed by heat sealing. The heat sealing melts opposite sides of the plastic tube together and creates an airtight seal. The method 9 for rolling two mattresses can be applied to many kinds of mattresses. For example, the first mattress 22 can be a bonnell spring mattress, a pocketed coil spring mattress or a foam mattress. The mattress 22 could even have a layer of memory foam above a layer of pocketed coils.

In step 11, the first mattress 22 is compressed such that the air exits the second end of the sheath 23. In one implementation, the mattress 22 is compressed by a flat surface that presses down on the mattress using mechanical force. In another implementation, air is removed from the second end of the sheath 23 using an air pump to create a vacuum, which causes the mattress to collapse into itself inside the airtight sheath 23.

In step 12, the sheath 23 is sealed such that air is prevented from re-entering the sheath. For example, the second end of the sheath 23 is sealed while the mattress 22 is compressed such that air is prevented from re-entering the sheath 23. The second end of the sheath 23 is then also closed using heal sealing.

Figure 2:
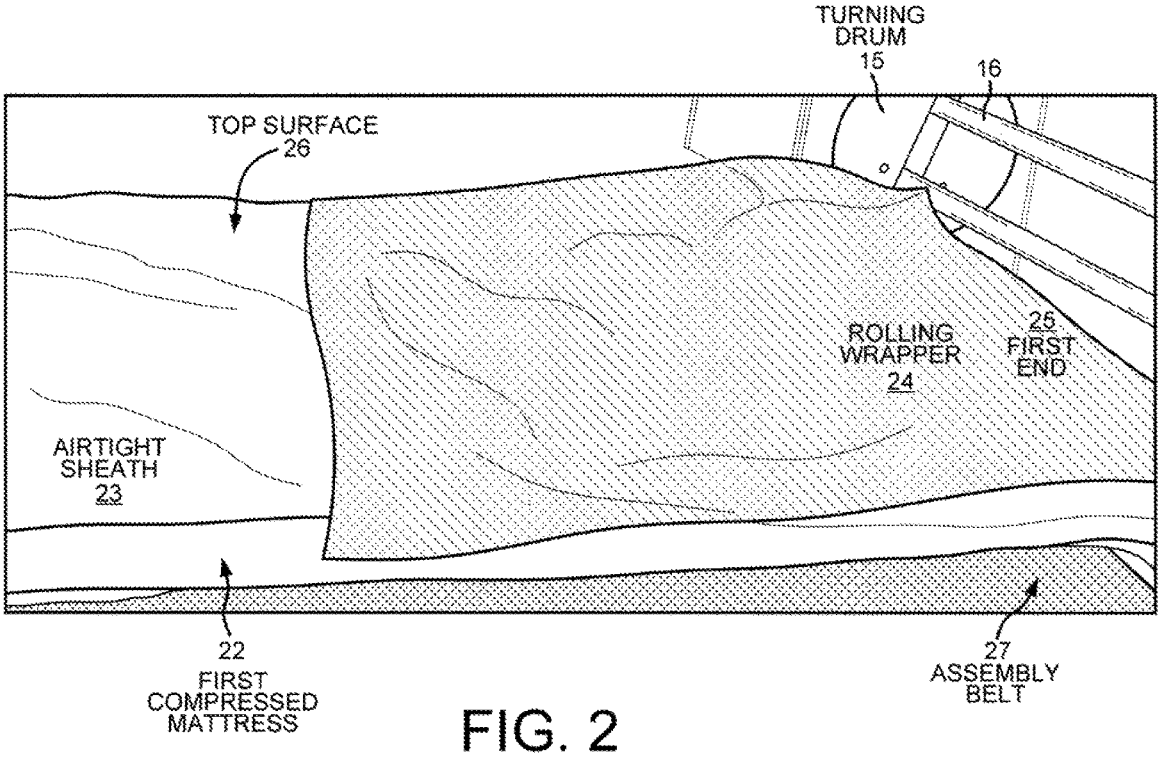
FIG. 2 shows a first compressed mattress on an assembly belt in an early step of the method of rolling of FIG. 1.

In step 13, a bottom surface of the first mattress 22 is placed on a rolling wrapper 24 such that the rolling wrapper wraps around a first end 25 of the first mattress and onto a top surface 26 of the first mattress. FIG. 2 shows the first compressed mattress 22 that has been placed on an assembly belt 27 in step 13. The first mattress 22 was previously inserted into the sheath 23. The bottom surface of the first mattress 22 has been placed on the rolling wrapper 24, which is wrapped around the first end 25 of the first mattress onto the top surface 26. In one orientation of the mattress, the first end 25 of mattress 22 could be the head of the mattress. The rolling wrapper 24 does not cover the entire top surface 26 of the first mattress 22. FIG. 2 shows the rolling wrapper 24 wrapped from the bottom surface around and onto the top surface 26 of the mattress 22. The rolling wrapper 24 covers about two thirds of the top surface 26 of the mattress 22 in FIG. 2. The rolling wrapper 24 is made of a high-strength material that can be a plastic film, a non-woven fabric or a woven fabric.

Figure 3:
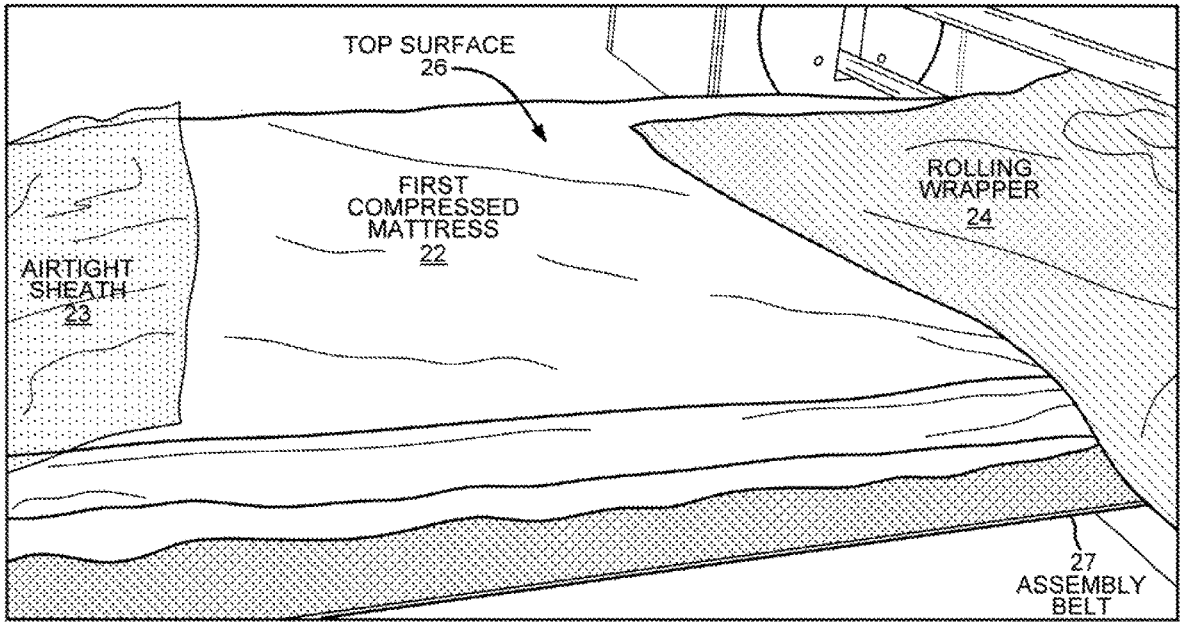
FIG. 3 shows the first mattress after it has been moved on the assembly belt.

FIG. 3 shows the first mattress 22 after it has been moved a couple of feet on the assembly belt 27 to the right in FIG. 2. The end of the airtight sheath 23 can be seen at the left in FIG. 3. This is the remainder of the sheath 23 beyond where an airtight seal has been made. The end of the sheath 23 has been folded over onto the top surface 26 of the first mattress 22.

Figure 4:
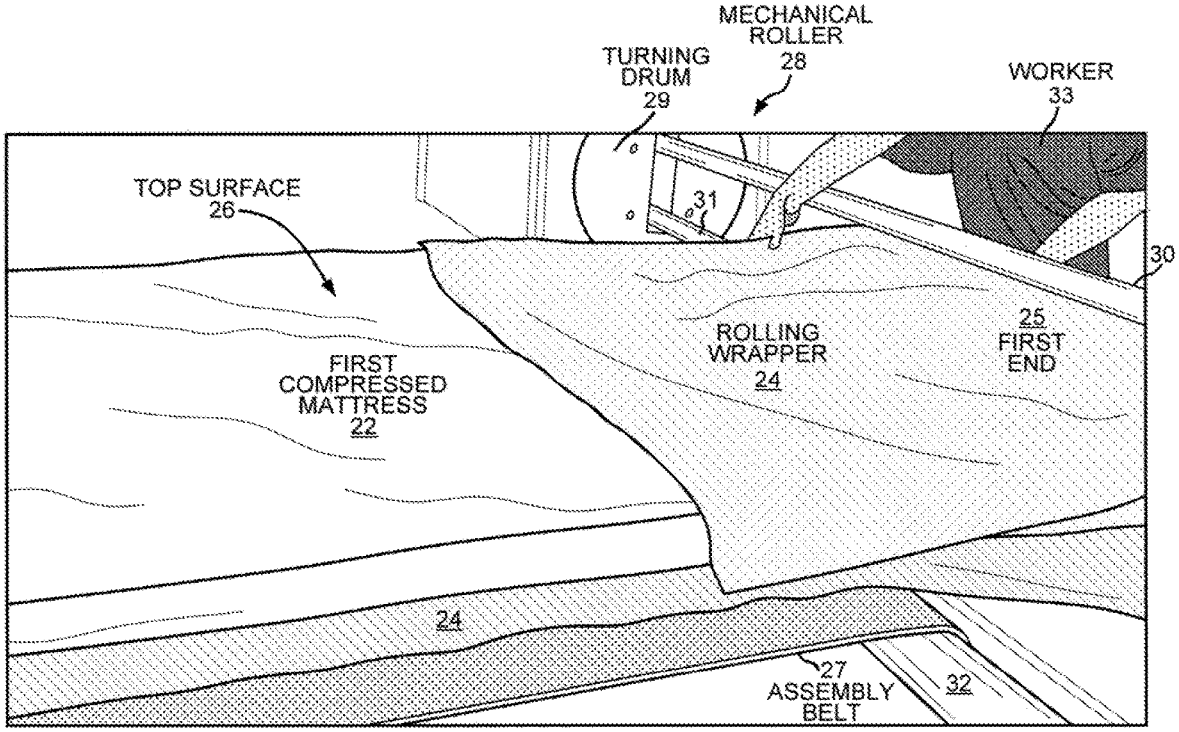
FIG. 4 shows a first end of the first mattress being inserted into a mechanical roller.

FIG. 4 illustrates step 14 in which the first end 25 of the first mattress 22 is being inserted into a mechanical roller 28. The mechanical roller 28 includes a turning drum 29, a first bar 30 and a second bar 31. The mattress 22, which is wrapped in the rolling wrapper 24, is being inserted under the first bar 30 in FIG. 4. FIG. 4 also shows a cylinder 32 about which the assembly belt 27 rolls. The assembly belt 27 is moved by rotating the cylinder 32.

Figure 5:
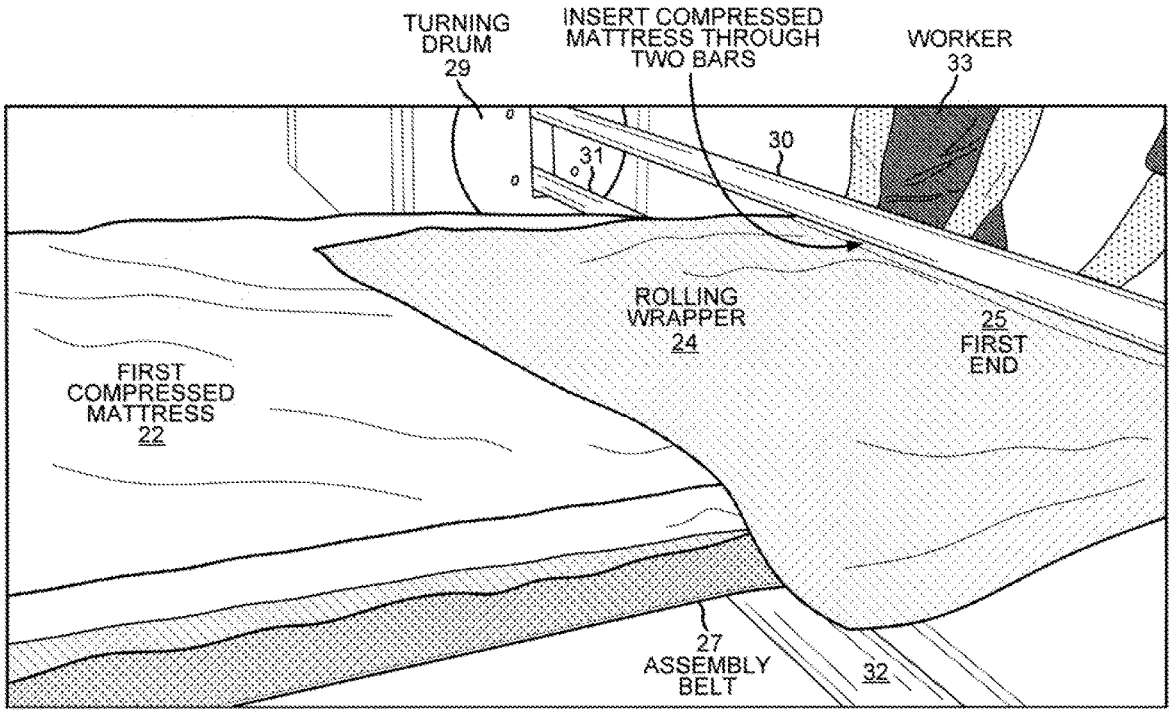
FIG. 5 shows the first mattress being inserted through a space between first and second bars of the roller.

FIG. 5 shows the first compressed mattress 22 being inserted through the space between the first bar 30 and the second bar 31. At this point in method 9, the turning drum 29 and the bars 30-31 have not begun to turn. In this implementation, the movement of the mattress 22 by the assembly belt 27 is manually assisted by workers 33 who pull the first compressed mattress 22 through the first bar 30 and the second bar 31. The rolling wrapper 24 in FIG. 5 has temporarily been misaligned as the workers pull unevenly on the wrapper 24.

Figure 6:
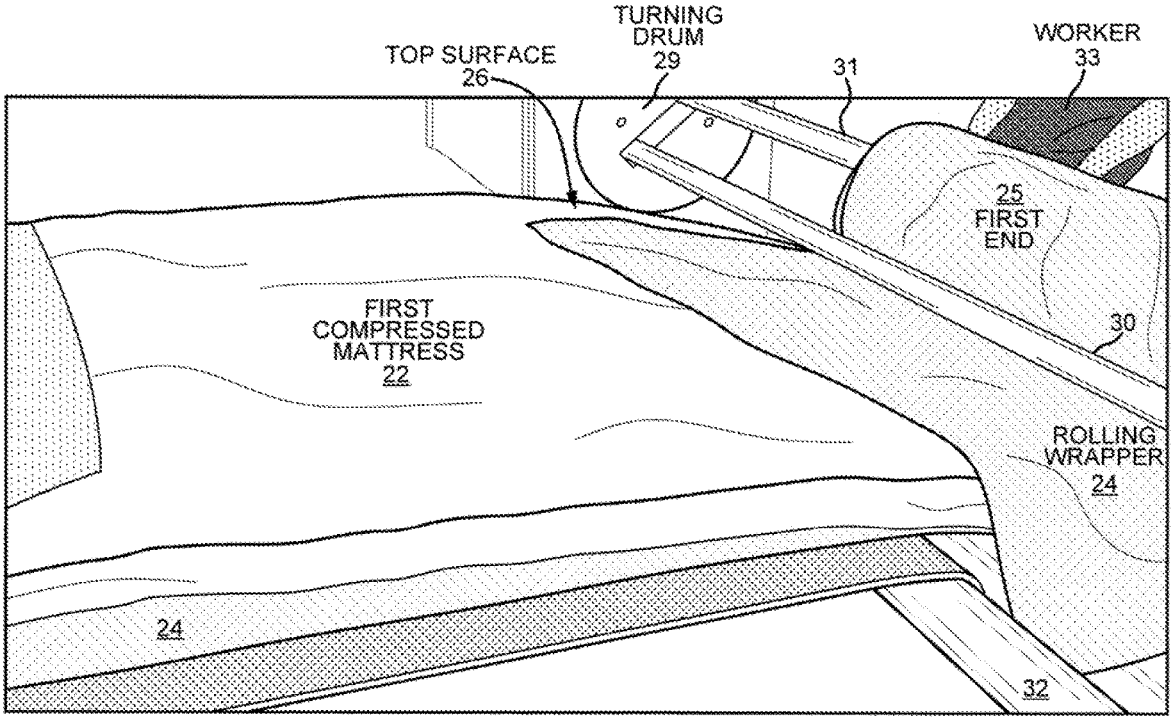
FIG. 6 shows a first end of the first mattress being bent over onto the top surface of the first mattress.

FIG. 6 illustrates step 15 in which a the first compressed mattress 22 is rolled by bending the first end 25 of the mattress over onto the top surface 26 of the first mattress 22. The first end 25 of the mattress 22 is bent by rotating the turning drum 29, which rotates the bars 30-31. The first bar 30 in FIG. 6 is now pressing down on a portion of the top surface 26 of the mattress 22, and the second bar 31 is pulling up on the bottom surface of the mattress closer to the first end 25 of the mattress 22. As the mattress 22 is rolled from the first end 25, the remainder of the mattress is pulled towards the bars 30-31 about which the mattress is being rolled. Both the top surface 26 and the bottom surface of the first mattress 22 are covered by the rolling wrapper 24 where the first end 25 of the first mattress 22 is rolled over onto the top surface of the first mattress.

Figure 7:
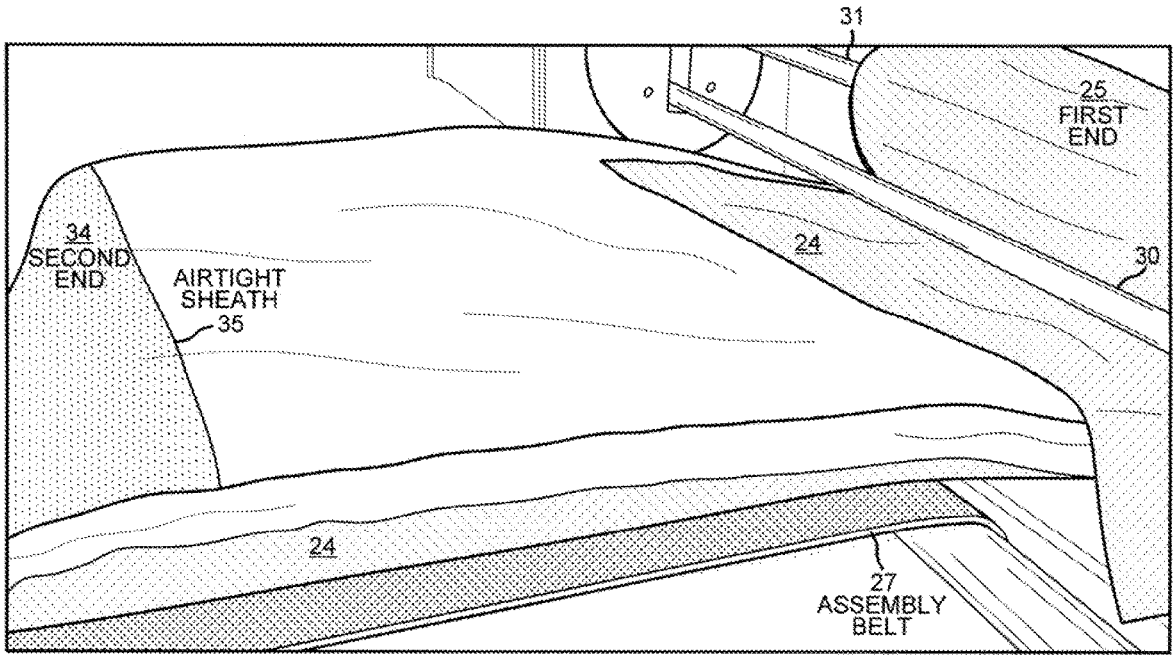
FIG. 7 shows an end portion of the mattress having been bent vertically.

FIGS. 7-11 show successive stages as the bars 30-31 rotate by 180 degrees and make a first half roll at the first end 25 of mattress 22. In step 16, the first mattress 22 is continued to be rolled such that successive portions of the bottom surface of the mattress become adjacent to successive portions of the top surface 26 of the first mattress 22. In FIG. 7, the portion of the mattress 22 immediately beyond the first bar 30 is approximately vertical. The workers 33 are holding onto the first end 25 to prevent that end of the mattress 22 from slipping under the second bar 31. The first mattress 22 has been pulled towards the bars 30-31 such that a second end 34 of the first mattress 22 is visible at the left of FIG. 7. A portion of an airtight sheath 35 of a second compressed mattress 36 is also visible at the left of FIG. 7.

Figure 8:
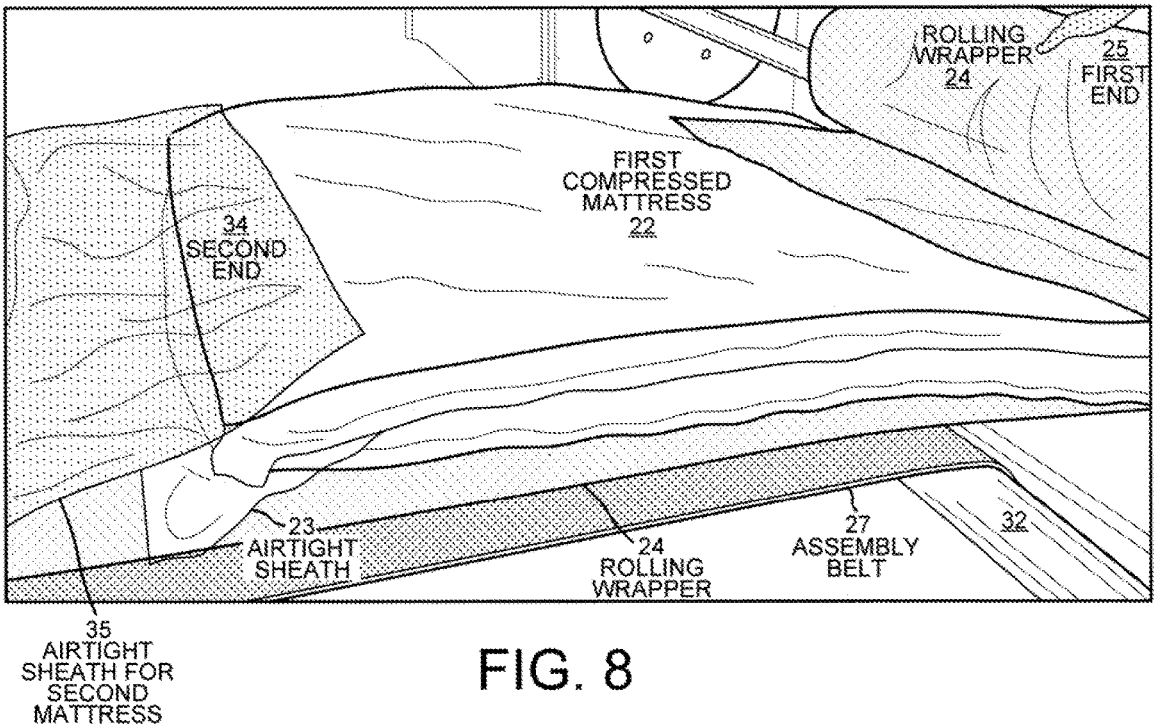
FIG. 8 shows the first end of the first mattress having been folded beyond vertical and almost touching the top surface of the remainder of the mattress.
Figure 9:
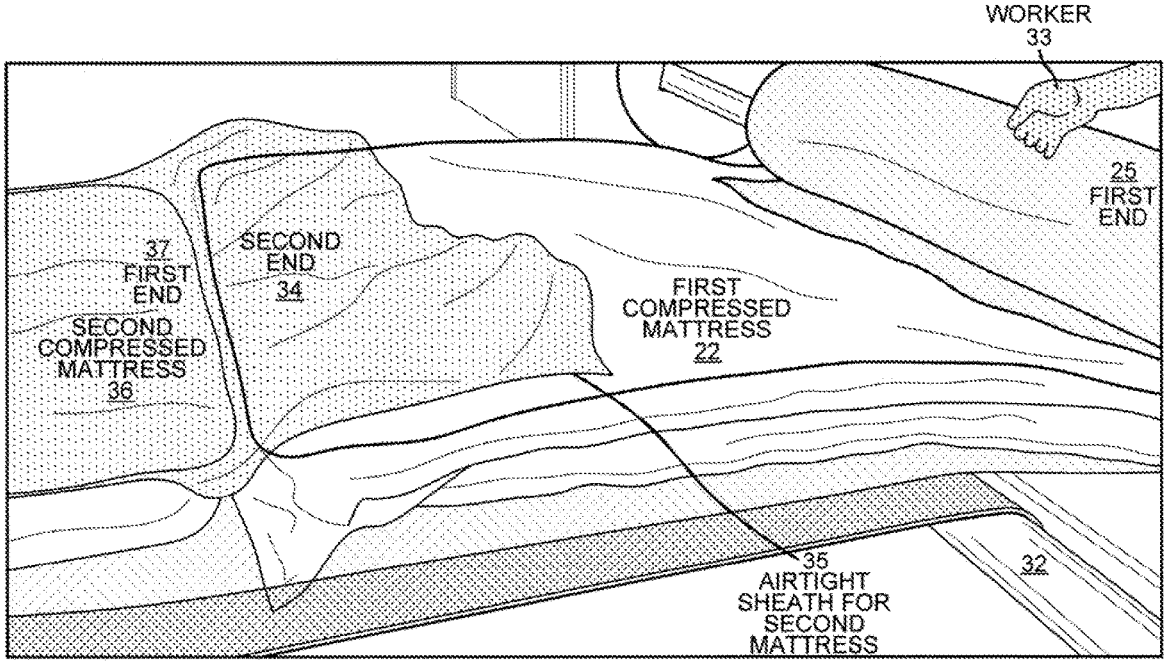
FIG. 9 shows a first end of a second compressed mattress having been placed on the rolling wrapper adjacent to the second end of the first compressed mattress.
Figure 10:
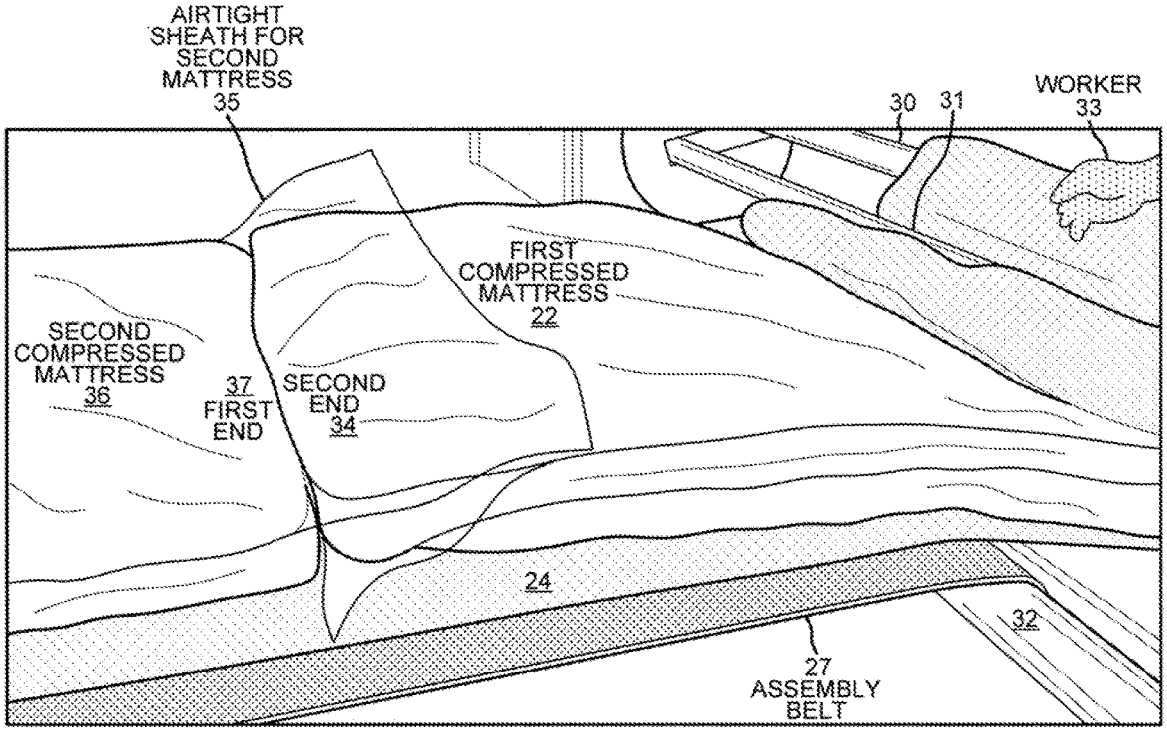
FIG. 10 shows the first end of the first mattress being rolled further than shown in FIG. 8.
Figure 11:
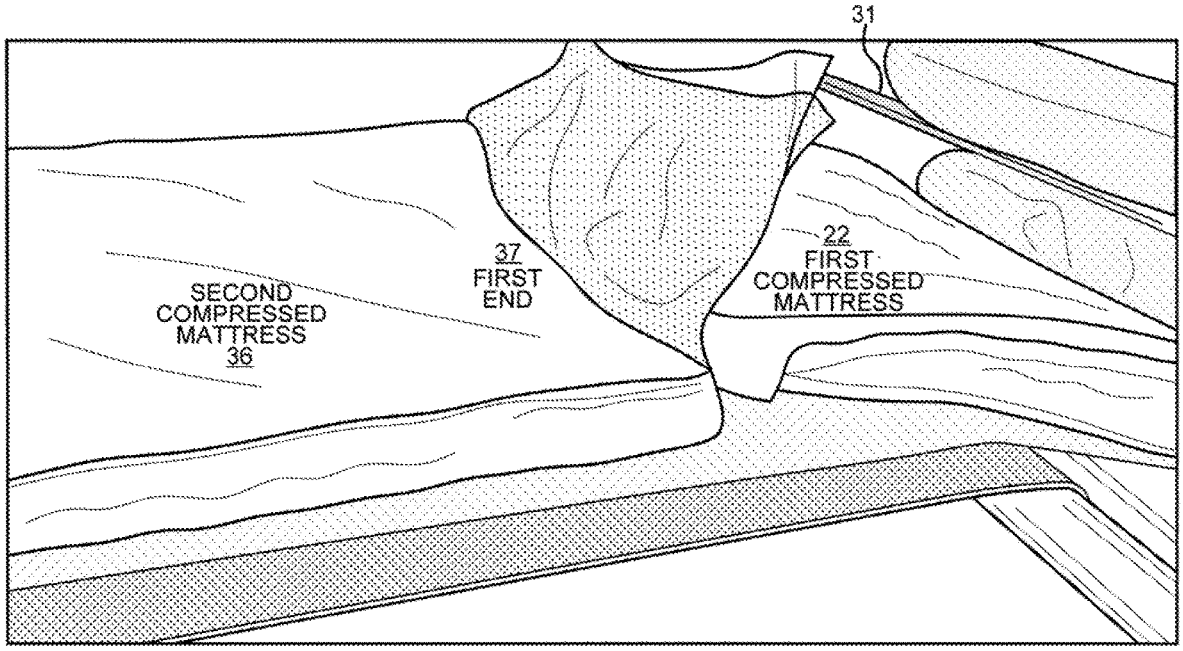
FIG. 11 shows the first end of the first mattress being rolled further than shown in FIG. 10.
Figure 12:
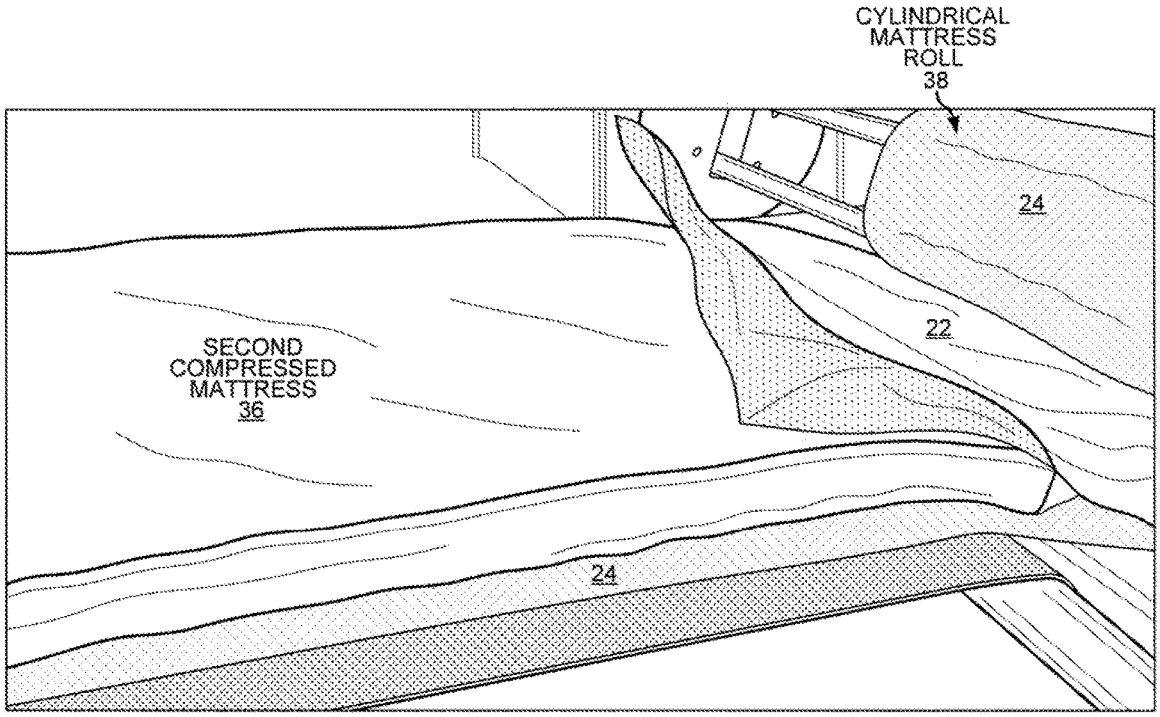
FIG. 12 shows the first mattress having been rolled further than shown in FIG. 11.
Figure 13:
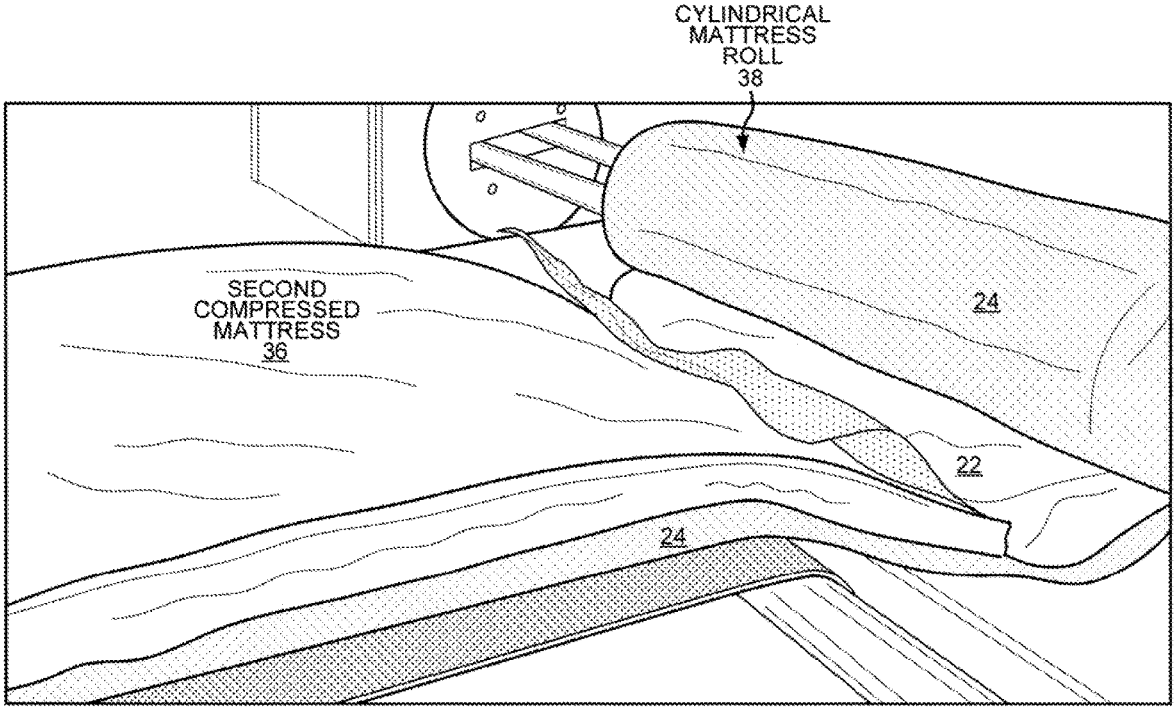
FIG. 13 shows the first mattress having been rolled further than shown in FIG. 12.
Figure 14:
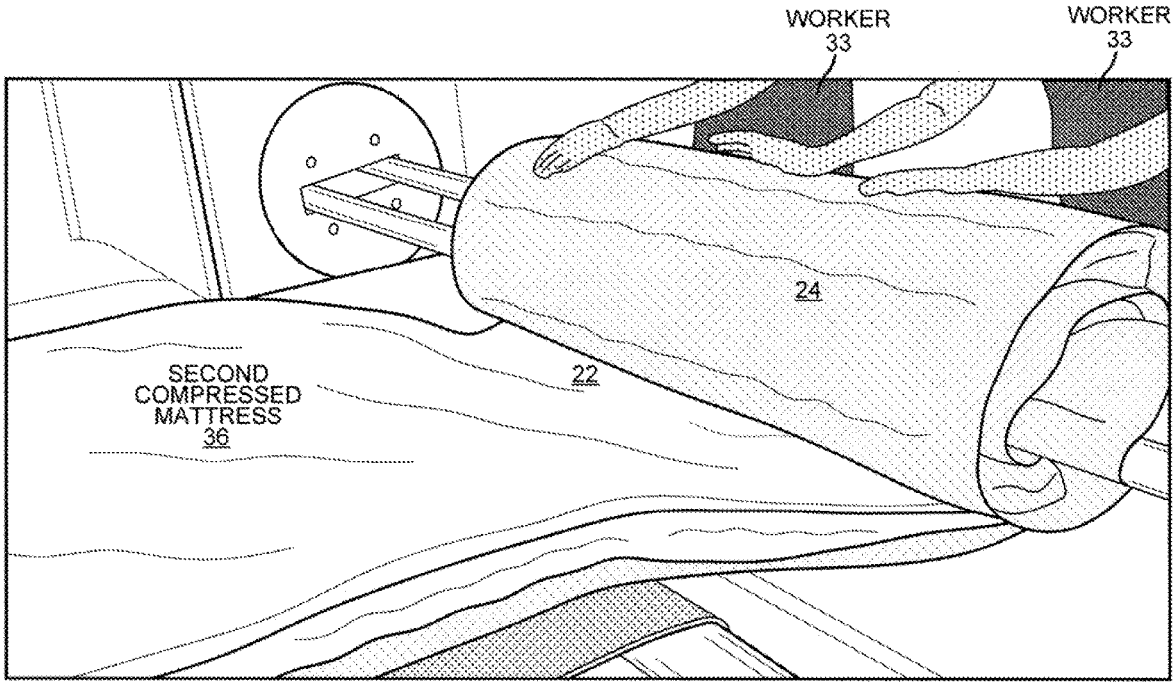
FIG. 14 shows the first mattress having been rolled further than shown in FIG. 13.

In FIG. 8, the portion of the first mattress 22 immediately past the first bar 30 has been folded beyond vertical and is almost folded onto the top surface 26 of the remainder of the mattress. In FIG. 9, a worker 33 has just let go of the first end 25, and the second bar 31 is pushing the first end 25 down onto the remainder of the top surface 26 of the first mattress 22.

In step 17, the bottom surface of the second mattress 36 is placed on the rolling wrapper 24 such that a first end 37 of the second mattress 36 is adjacent to the second end 34 of the first mattress 22, as shown in FIG. 9.

Figure 15:
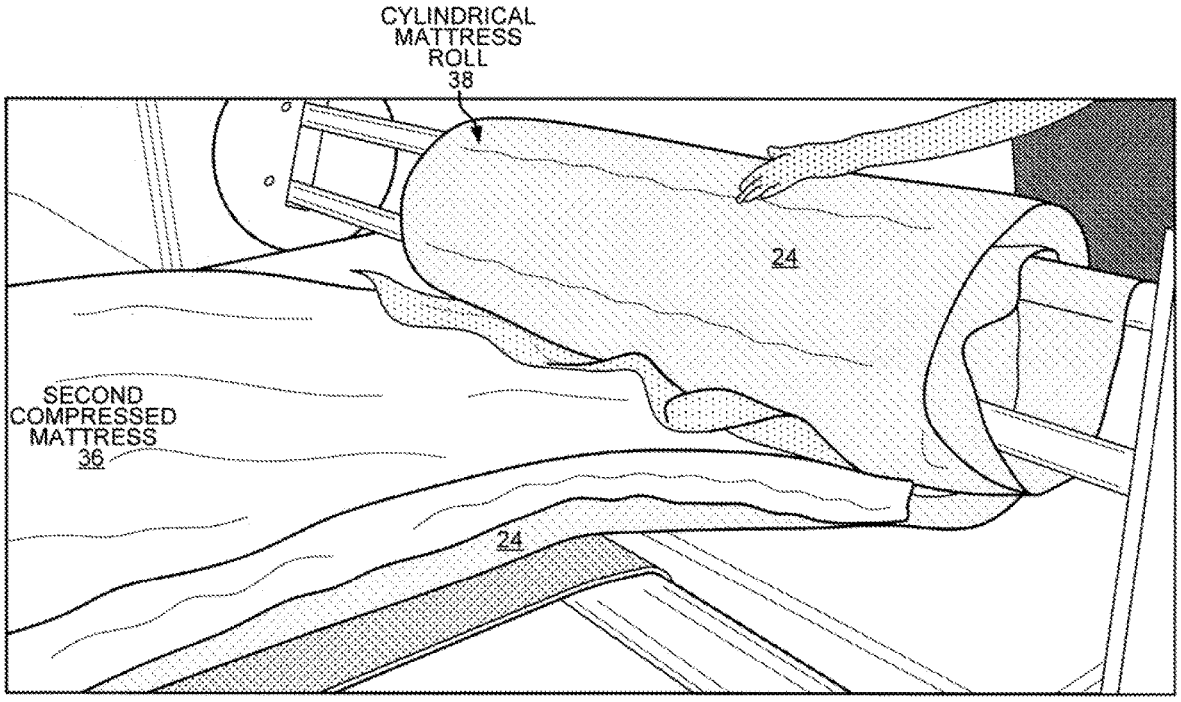
FIG. 15 shows the first mattress having been completely rolled with the rolling wrapper extending under the unrolled second mattress.

FIGS. 10-15 show how the bars 30-31 continue to roll the first mattress 22 such that successive portions of the bottom surface of the first mattress 22 become adjacent to successive portions of the top surface 26 of the first mattress 22. The first mattress 22 is rolled until the rolling wrapper 24 makes direct contact with other portions of the rolling wrapper over at least one revolution of the cylindrical mattress roll. In FIG. 15, the first compressed mattress 22 has been completely rolled, and the rolling wrapper 24 forms a spiral when viewed from an end of the cylindrical mattress roll 38. The rolling wrapper 24 extends from the mattress roll under the second compressed mattress 36.

Figure 16:
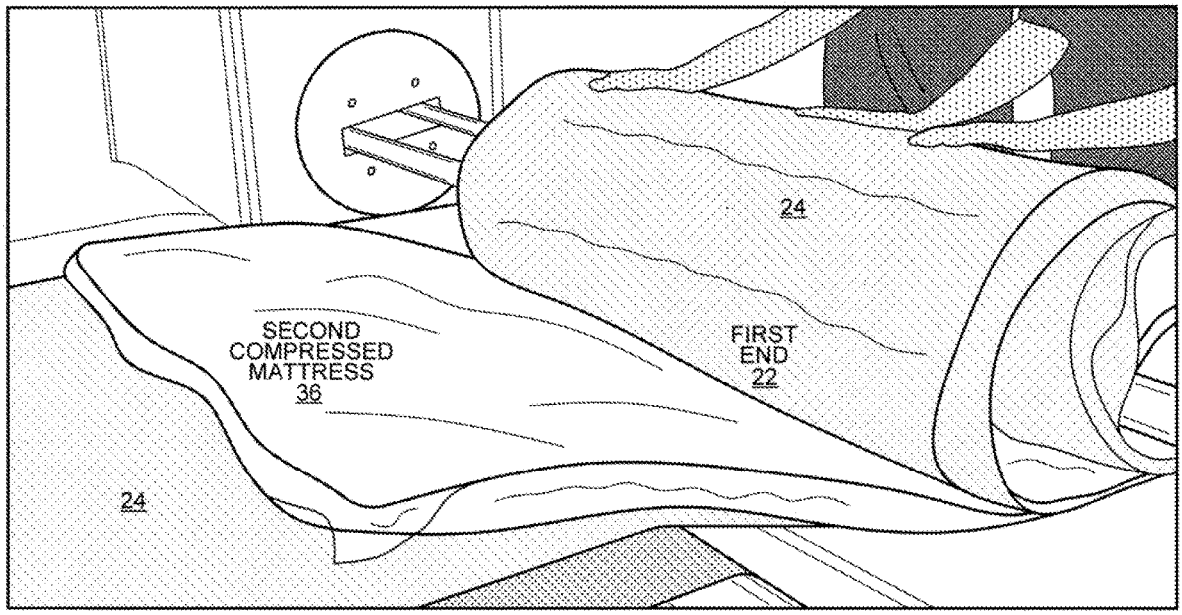
FIG. 16 shows the first mattress being rolled such that successive portions of the bottom surface of the first mattress have become adjacent to successive portions of the top surface of the second mattress.

FIG. 16 illustrates step 18 in which the bars 30-31 continue to rotate and to roll the first mattress 22 such that successive portions of the bottom surface of the first mattress 22 become adjacent to successive portions of a top surface of the second mattress 36. FIG. 16 shows the point in the rolling at which the second mattress 36 has completely wrapped around the first mattress 22.

Figure 17:
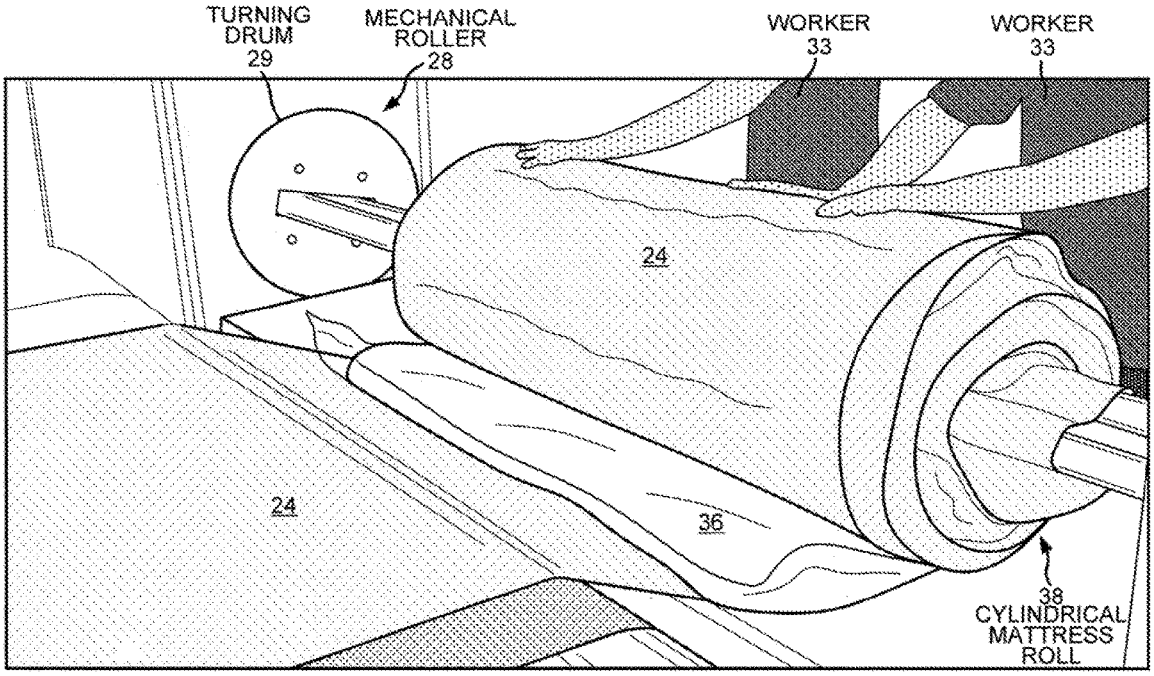
FIG. 17 shows the second mattress almost completely wrapped around the cylindrical roll of the two compressed mattresses.

In step 19, the bars 30-31 continue to roll the first mattress 22 such that successive portions of the bottom surface of the second mattress 36 become adjacent to successive portions of the top surface of the second mattress 36. In FIG. 17, the second mattress 36 has almost been completely wrapped around the cylindrical roll 38 of two compressed mattresses.

Figure 18:
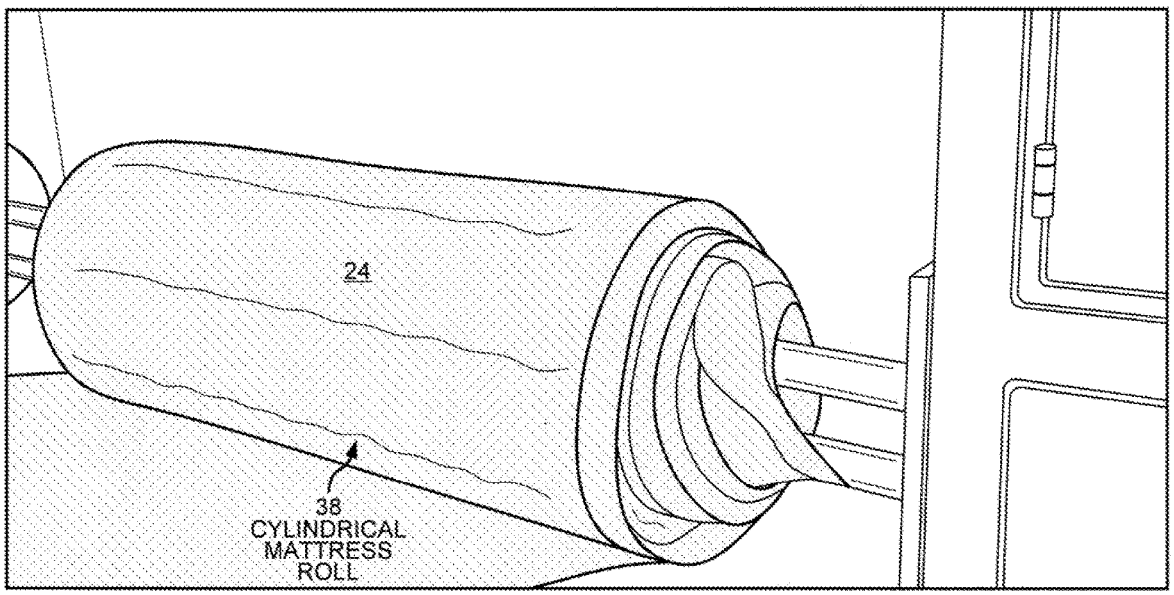
FIG. 18 shows the rolling wrapper being wrapped around portions of the second mattress that have already been covered by the rolling wrapper.
Figure 19:
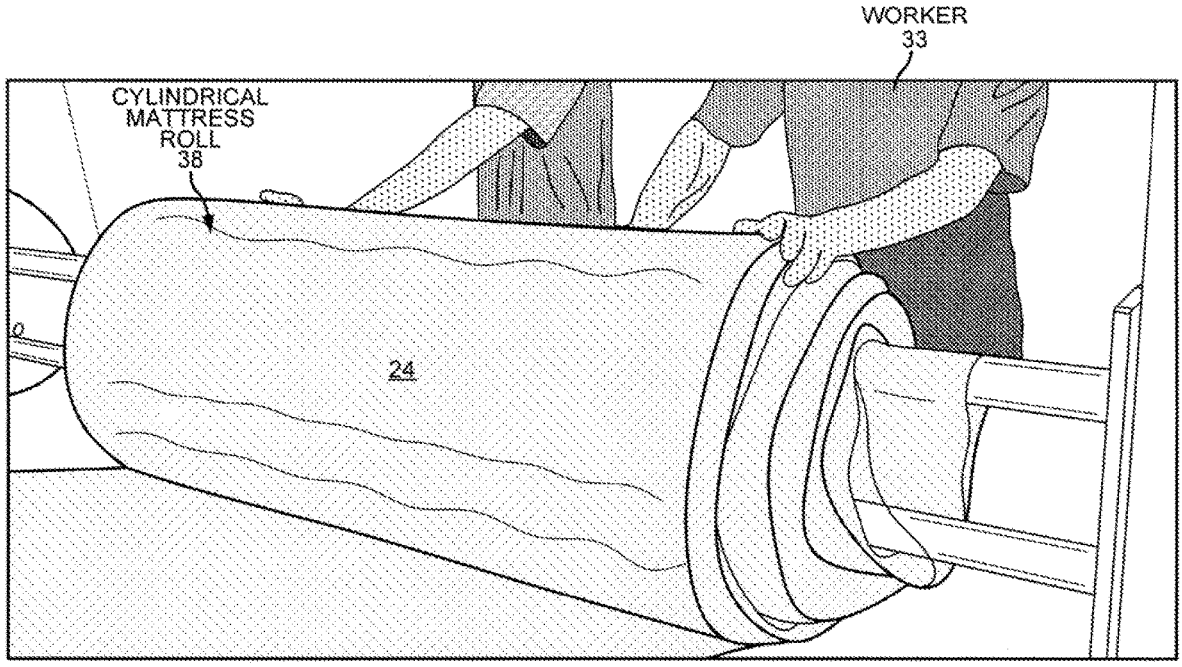
FIG. 19 shows a point in the rolling and packaging method of FIG. 1 at which the first mattress and the second mattress have further been rolled until the wrapper has made at least a complete wrap around portions of the second mattress that have already been covered by the wrapper.

In step 20, the first mattress 22 and the second mattress 36 are rolled until the rolling wrapper 24 makes at least a complete wrap around portions of the second mattress 36 that are already covered by the rolling wrapper. FIGS. 18-19 illustrate the rolling wrapper 24 being wrapped around portions of the second mattress 36 that have already been covered by the rolling wrapper.

Figure 20:
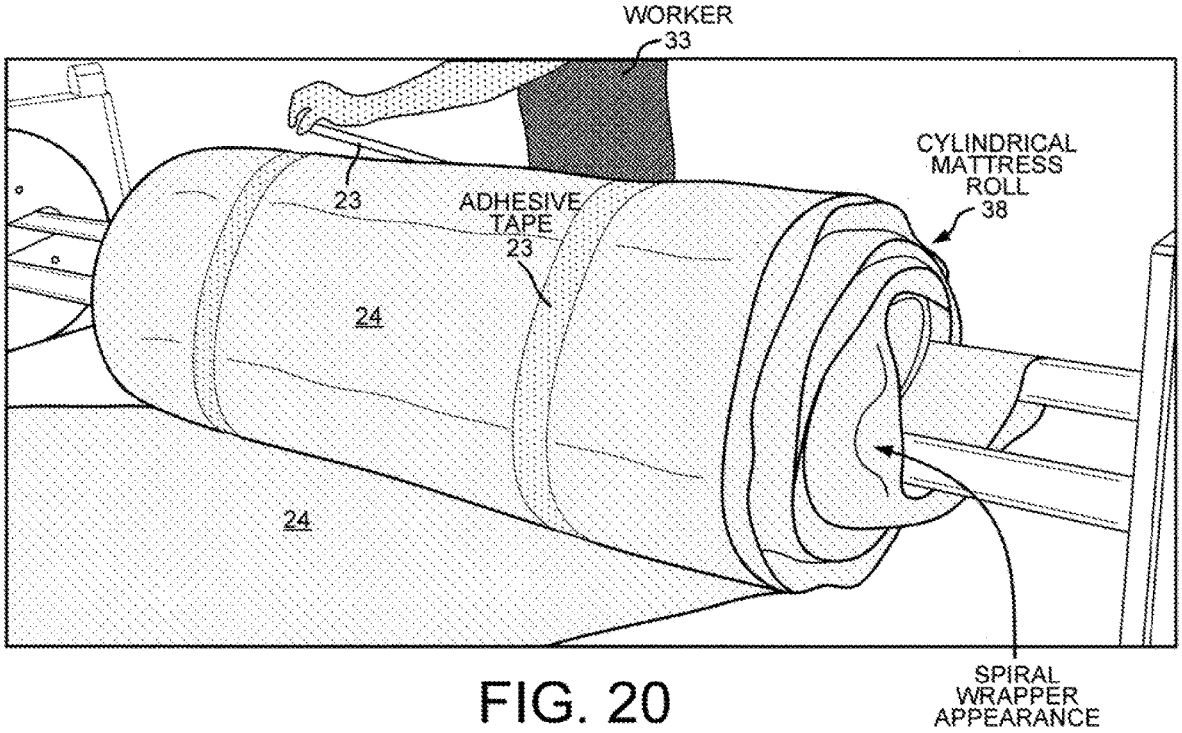
FIG. 20 shows strips of tape being applied to the wrapper around the mattress roll before the wrapper is cut.

In step 21, a first location on the rolling wrapper 24 is taped to a second location on the rolling wrapper that has completed an additional wrap around the second mattress 36. The sheet of rolling wrapper 24 is cut so that a location at the cut end can be taped to another location on the outside of the cylindrical mattress roll 38. FIG. 20 shows strips of adhesive tape 39 being applied to the rolling wrapper 24 around the cylindrical mattress roll 38 before the wrapper is cut. The first mattress 22 and the second mattress 36 form the cylindrical roll 38 in which the rolling wrapper 24 appears as a spiral when viewed from an end of the cylindrical roll 38, as shown in FIG. 20. After the rolling wrapper 24 has been cut and taped so that the mattress roll 38 cannot unravel, the bars 30-31 are pulled out of the first mattress 22 whose first end 25 has been rolled around the bars.

Figure 21:
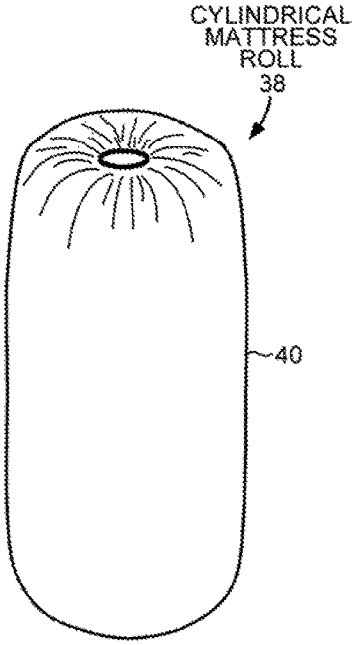
FIG. 21 shows a duffel bag into which the roll of compressed mattresses has been inserted.
Figure 22:
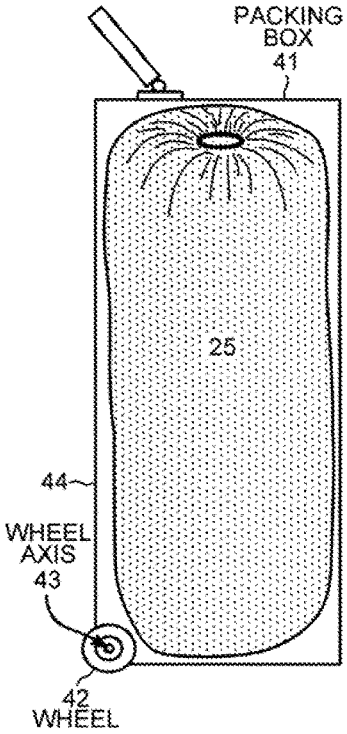
FIG. 22 shows a bag containing the mattress roll which has been placed in a packing box with a handle and wheels.

In a next step, the cylindrical roll 38 of compressed mattresses 22, 36 is placed in a bag. FIG. 21 shows a duffel bag 40 in which the roll 38 of compressed mattresses has been inserted. The bag 40 containing the mattress roll 38 can then be placed in a packing box 41 with a handle and wheels, as shown in FIG. 22. The packing box is made of cardboard and has two wheels 42, each of which rotates about a common fixed axis 43 of rotation. The axis 43 of rotation passes through the box 41 above the bottom side and in front of the back side 44.

The packing box 41 contains two compactly packaged mattresses that can be placed on a retail-store merchandise shelf to be purchased by a retail consumer. A retail customer can be offered a "twin pack" containing both the first compressed mattress and the second compressed mattress in a single packing box. The packing box 41 is small enough to be brought from the store shelf to the check-out counter and then to the trunk of the consumer's car. Packaging two mattresses in a single box reduces the cost of shipping, warehousing and retail shelf space for the mattresses and thereby allows the mattresses to be sold at a lower price.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. A method comprising:

inserting a first mattress into a sheath;

compressing the first mattress such that air exits the sheath;

sealing the sheath such that air is prevented from re-entering the sheath;

placing a bottom surface of the first mattress on a rolling wrapper such that the rolling wrapper wraps around a first end of the first mattress and onto a top surface of the first mattress, wherein the bottom surface of the first mattress has a length;

inserting the first end of the first mattress into a mechanical roller;

rolling the first mattress by bending the first end of the first mattress over onto the top surface of the first mattress, wherein both the top surface and the bottom surface of the first mattress are covered by the rolling wrapper where the first end of the first mattress is rolled over onto the top surface of the first mattress;

continuing to roll the first mattress such that successive portions of the bottom surface of the first mattress become adjacent to successive portions of the top surface of the first mattress and such that the entire length of the bottom surface of the first mattress is covered by the rolling wrapper;

placing a bottom surface of a second mattress on the rolling wrapper such that a first end of the second mattress is adjacent to a second end of the first mattress, wherein the bottom surface of the second mattress has a length;

continuing to roll the first mattress such that successive portions of the bottom surface of the first mattress become adjacent to successive portions of a top surface of the second mattress;

continuing to roll the first mattress such that successive portions of the bottom surface of the second mattress become adjacent to successive portions of the top surface of the second mattress and such that the entire length of the bottom surface of the second mattress is covered by the rolling wrapper; and taping a first location on the rolling wrapper to a second location on the rolling wrapper that has completed an additional wrap around the second mattress.

2. The method of claim 1, wherein the first mattress is taken from the group consisting of: a bonnell spring mattress, a pocketed coil spring mattress, and a foam mattress.

3. The method of claim 1, wherein the sheath is made of polypropylene.

4. The method of claim 1, wherein the sheath is sealed using heat sealing.

5. The method of claim 1, wherein the rolling wrapper is made of a material taken from the group consisting of: a non-woven fabric, a woven fabric, and a plastic film.

6. The method of claim 1, wherein the rolling wrapper is a high-strength woven fabric.

7. The method of claim 1, wherein the mechanical roller has two rotating drums connected by two bars.

8. The method of claim 7, wherein the inserting the first end is performed by inserting the first end of the first mattress between the two bars.

9. The method of claim 1, wherein the rolling wrapper does not cover the entire top surface of the first mattress.

10. The method of claim 1, wherein the first mattress is rolled until the rolling wrapper makes direct contact with other portions of the rolling wrapper over at least one revolution.

11. The method of claim 1, wherein the mechanical roller has two rotating bars, and wherein the inserting the first end is performed by inserting the first end of the first mattress between the two bars, further comprising:

pulling the bars out of the first mattress that is rolled around the bars.

12. The method of claim 1, wherein the first mattress and the second mattress form a cylindrical roll in which the rolling wrapper forms a spiral when viewed from an end of the cylindrical roll.

13. The method of claim 1, wherein the first mattress and the second mattress form a roll, further comprising:

placing the roll in a bag.

14. The method of claim 13, further comprising:

placing the bag in a packing box.

15. The method of claim 1, wherein the first mattress and the second mattress form a roll, further comprising:

placing the roll in a packing box.

16. A method comprising:

inserting a first mattress into a sheath;

compressing the first mattress such that air exits the sheath;

sealing the sheath such that air is prevented from re-entering the sheath;

placing a bottom surface of the first mattress on a rolling wrapper such that the rolling wrapper wraps around a first end of the first mattress and onto a top surface of the first mattress;

inserting the first end of the first mattress into a mechanical roller;

rolling the first mattress by bending the first end of the first mattress over onto the top surface of the first mattress, wherein both the top surface and the bottom surface of the first mattress are covered by the rolling wrapper where the first end of the first mattress is rolled over onto the top surface of the first mattress;

continuing to roll the first mattress such that successive portions of the bottom surface of the first mattress become adjacent to successive portions of the top surface of the first mattress;

placing a bottom surface of a second mattress on the rolling wrapper such that a first end of the second mattress is adjacent to a second end of the first mattress;

continuing to roll the first mattress such that successive portions of the bottom surface of the first mattress become adjacent to successive portions of a top surface of the second mattress;

continuing to roll the first mattress such that successive portions of the bottom surface of the second mattress become adjacent to successive portions of the top surface of the second mattress, wherein the first mattress is rolled until the rolling wrapper makes at least a complete wrap around portions of the second mattress that are already covered by the rolling wrapper; and taping a first location on the rolling wrapper to a second location on the rolling wrapper that has completed an additional wrap around the second mattress.

17. A method comprising:

placing a bottom surface of a first compressed mattress on a rolling wrapper such that the rolling wrapper wraps around a first end of the first compressed mattress;

inserting the first end of the first compressed mattress into a mechanical roller;

rolling the first compressed mattress by bending the first end of the first compressed mattress over onto the top surface of the first compressed mattress, wherein both the top surface and the bottom surface of the first compressed mattress are covered by the rolling wrapper where the first end of the first compressed mattress is rolled over onto the top surface of the first compressed mattress;

placing a bottom surface of a second compressed mattress on the rolling wrapper such that a first end of the second compressed mattress is adjacent to a second end of the first compressed mattress;

continuing to roll the first compressed mattress such that successive portions of the bottom surface of the second compressed mattress become adjacent to successive portions of the top surface of the second compressed mattress;

continuing to roll the first compressed mattress until the rolling wrapper makes at least a complete wrap around portions of the second compressed mattress that are already covered by the rolling wrapper; and taping a first location of the rolling wrapper to a second location on the rolling wrapper that has completed an additional wrap around the second compressed mattress.

18. The method of claim 17, wherein the first compressed mattress is disposed inside an airtight sheath such that air is prevented from entering the sheath.

19. The method of claim 17, wherein the first compressed mattress and the second compressed mattress form a roll, further comprising:

placing the roll in a packing box.

20. The method of claim 19, further comprising:

supplying the first compressed mattress and the second compressed mattress in the packing box to a retail consumer.

* * * * *